United States Patent [19]

Newcomb

[11] 4,259,672

[45] Mar. 31, 1981

[54] MULTI-BAND VERTICAL ANTENNA

[75] Inventor: Donald R. Newcomb, Lake Crystal, Minn.

[73] Assignee: Butternut Electronics, San Marcos, Tex.

[21] Appl. No.: 76,571

[22] Filed: Sep. 18, 1979

[51] Int. Cl.[3] ..... H01Q 9/14; H01Q 9/22

[52] U.S. Cl. ..... 343/722; 343/723; 343/750

[58] Field of Search ..... 343/749, 750, 751, 752, 343/722, 723, 900, 901

[56] References Cited

U.S. PATENT DOCUMENTS

| | | | |
|---|---|---|---|
| 2,647,211 | 7/1953 | Smeby | 343/752 |
| 2,648,771 | 8/1953 | Cork | 343/749 |
| 3,176,298 | 3/1965 | Mettles | 343/749 |
| 3,653,053 | 3/1972 | Vrain | 343/750 |

*Primary Examiner*—Eli Lieberman

*Attorney, Agent, or Firm*—Hugh D. Jaeger

[57] ABSTRACT

A vertical antenna which is omnidirectional and includes completely automatic band switching for the amateur radio frequencies of, eighty/seventy-five meters, forty meters, twenty meters, fifteen meters, and ten meters. The vertical antenna has a low angle of radiation and a low standing wave ratio on all frequencies which provides for direct coaxial cable transmission line feed. The eighty-meter and forty-meter resonator capacitor sections provide inductive reactance for operation on eighty/seventy five meters and forty meters while permitting simultaneous resonance on each of the three higher frequencies of twenty, fifteen, and ten meters. The entire radiator length of the vertical antenna is active on all frequencies except for fifteen meters where the upper portion of the antenna is decoupled above an end of a fifteen-meter quarter-wave decoupling stub in a first embodiment. The entire radiator length of the vertical antenna is active on all frequencies in a second embodiment.

12 Claims, 4 Drawing Figures

MULTI-BAND VERTICAL ANTENNA

BACKGROUND OF THE INVENTION

1. Field of the Invention

The present invention relates generally to an antenna, and, more particularly, pertains to a high-frequency vertical antenna.

2. Description of the Prior Art

Those concerned with antennas have long recognized the need for a high-frequency vertical antenna including automatic band switching. The present invention fulfills this need.

The traditional prior art vertical antennas have relied on anti-resonant inductor-capacitor circuit traps placed at or near the quarter-wave current antinode points to decouple varying lengths of the available radiating structure on those bands where the total height of the vertical antenna was greater than an electrical quarter wavelength. The approach provided that the overall height of the radiating structure was typically less than a quarter wavelength at the lowest frequency of operation and the exact height was largely determined by the inductance-capacitance ratio of the traps. The usual method of providing eighty-meter resonance in vertical antennas was to utilize a high inductance coil at the top of the structure which simultaneously served as a forty-meter decoupling trap and as a loading for eighty-meter resonance. In most designs, additional loading in the form of capacity hats was used to limit the overall height of the structure to something less than one-eighth wavelength on the lowest frequency. The physical height of the active radiating sections was usually less than a quarter wavelength because of the inductive reactance of the several decoupling traps at frequencies below the frequencies to which the decoupling traps were tuned.

The prior art vertical antennas have had a number of limitations. First, the active antenna height on all but the highest frequency band was necessarily less than one quarter wavelength resulting in a radiation resistance which progressively decreased from a high impedance on the highest frequency of operation to a few ohms on the lowest frequency of operation. Second, the use of numerous traps and other loading devices increased the system Q and unnecessarily restricted the band width, especially on the mid-range HF (high frequency) frequencies where the active radiator height would be less than that required for unloaded resonance operation. Third, from a mechanical viewpoint, the use of numerous traps and loading devices in the upper sections of the vertical antenna made for a relatively unstable and heavy structure which required heavy and expensive construction for a freestanding wind survival rating. Fourth, a further difficulty had to do with the ease of adjustments for resonance at the desired frequencies in the low HF frequencies. Inasmuch as adjustment in the past for these frequencies had to be made in the upper sections of the antenna, the entire vertical antenna had to be removed from its mounting and brought to ground level for the slightest readjustment. This was a particularly inconvenient feature of operation as the effective operating band width of the vertical antenna was generally less than twenty percent of the authorized band spectrum.

The present invention provides a vertical antenna that overcomes all the disadvantages of the prior art vertical antennas.

SUMMARY OF THE INVENTION

The general purpose of this invention is to provide a high-frequency vertical antenna which is resonant on five amateur radio HF bands.

According to a first embodiment of the present invention, there is provided a high-frequency vertical antenna for use on the amateur radio high-frequency spectrum segments having an eighty-meter capacitor section and including an adjustable inductor connected across the capacitor section, a forty-meter capacitor section connected to the eighty-meter capacitor section and including an adjustable inductor connected across the capacitor section, an upper vertical radiating section including a fifteen-meter quarter-wave stub section connected to the forth-meter capacitor section whereby the overall antenna height is resonated on eighty and forty meters, the vertical antenna resonates as a quarter wavelength on twenty meters, the vertical antenna resonates as a quarter wavelength on fifteen meters on account of decoupling of the upper vertical radiating section of the antenna by the fifteen-meter stub section, and the vertical antenna resonates as three-quarters wavelength on ten meters.

According to a second embodiment of the present invention, there is provided a vertical antenna similar to the first embodiment except that a stub connects directly above the forty-meter capacitor section and extends substantially parallel to the vertical radiating section whereby the entire vertical antenna radiates on all frequencies.

One significant aspect and feature of the present invention is a vertical antenna which is omnidirectional including completely automatic band switching, and can operate on all HF amateur frequencies of eighty meters through ten meters.

Having briefly described one embodiment of the present invention, it is a principal object hereof to provide a vertical antenna for operation on the high-frequency amateur radio frequencies of eighty meters through ten meters. The frequency segments are eighty/seventy-five meters, forty meters, twenty meters, fifteen meters, and ten meters. While the present invention has been disclosed for use on the five amateur radio frequency segments of the high-frequency spectrum, the specification is not to be constructed as limiting of the present invention, as the principles of operation can be extended to any frequencies of operation as predetermined.

An object of the present invention is a vertical antenna which operates on all of the amateur radio HF spectrum assignments as set forth by the Federal Communications Commission and requires no manual band switching when changing frequencies. The band switching is automatic and electrical in the figurative sense, in that the entire height of the vertical antenna radiates on all frequencies except for fifteen meters where the upper portion of the antenna is automatically and electrically decoupled for quarter wavelength operation on fifteen meters in the first embodiment. The automatic and electrical band switching eliminates the need for manual band switching from the physical antenna itself or from a remote point. In a second embodiment, the entire vertical antenna radiates on all frequencies.

Another object of the present invention is to provide a vertical antenna with fewer traps or tuned circuits than the prior art vertical antennas, thus simplifying the vertical antenna with resultant economies in time and construction materials. By utilizing resonator capacitor sections, fewer decoupling traps are required.

A further object of the present invention is to provide a vertical antenna having greater efficiencies because of longer active radiating sections on the upper high-frequency spectrum segments. Consequently, the band width is substantially increased for the high-frequency spectrum segments because of the lower Q of the longer radiating sections and top loading for each of the spectrum segments.

An additional object of the present invention is to provide a vertical antenna which provides readily accessible in-place adjustment on the forty- and eighty-meter bands where the Q is the highest.

Still an additional object of the present invention is to provide a vertical antenna which has small wind loading because the principal frequency control circuits are mounted in and on the lower half of the vertical antenna. The upper half of the antenna only needs to support its own weight thereby being much lighter and requiring smaller diameter metal tubing.

BRIEF DESCRIPTION OF THE DRAWINGS

Other objects and many of the attendant advantages of this invention will be readily appreciated as the same becomes better understood, by reference to the following detailed description when considered in connection with the accompanying drawings, in which like reference numerals designate like parts throughout the figures thereof and wherein.

DESCRIPTION OF FIRST PREFERRED EMBODIMENT

Figure 1:
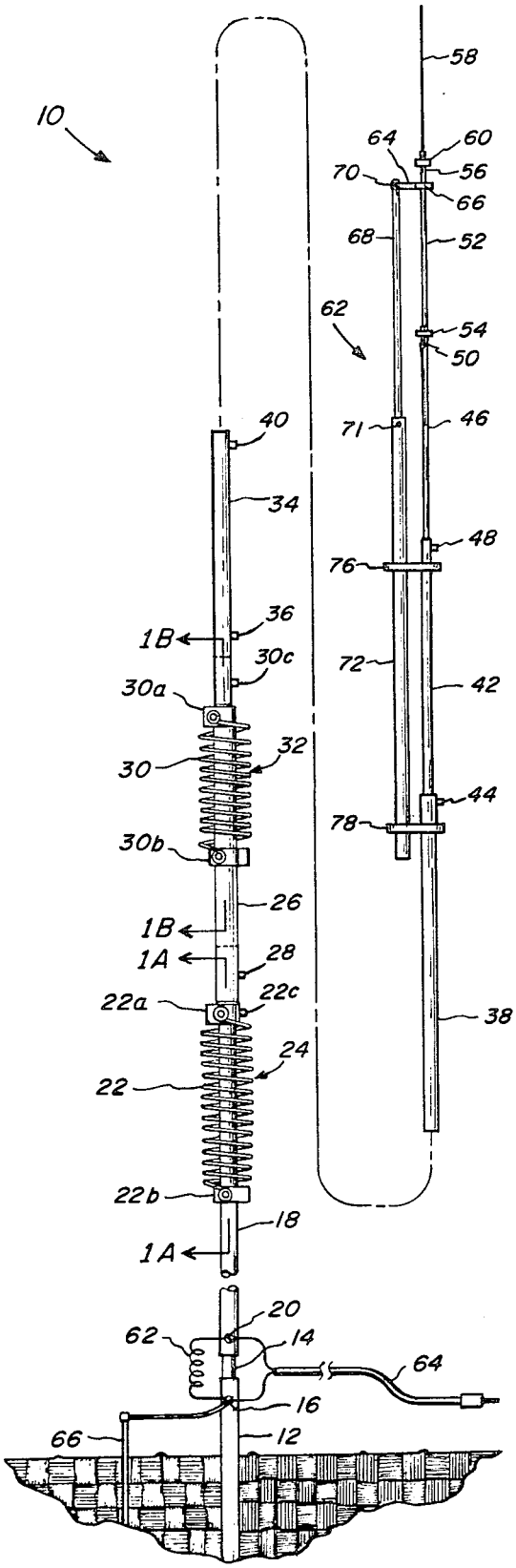
FIG. 1 illustrates a plan view of a first embodiment of a vertical antenna, the present invention.

FIG. 1, which illustrates a vertical plan view of a vertical antenna 10, the present invention, shows a metal hollow tubular mounting post 12 having a solid rod fiberglass insulator 14 of a diameter which telescopes internally into the mounting post 12, and secures thereto with a nut and bolt assembly 16. An eighty/seventy-five meter resonator capacitor metal section 18 having a lower hollow tubular portion of a diameter which telescopes over the solid insulator 14 and secures thereto with a nut and bolt assembly 20. An eighty-meter resonator coil 22 clamps between a top portion of the eighty-meter resonator capacitor section 18 to a position immediately below an insulator assembly 24 as later described in FIG. 1A. Coil clamps **22*a* and 22*b* surround the top portion of the eighty-meter resonator capacitor section 18, position immediately below the insulator assembly 24 respectively, and secure thereto with nut and bolt assemblies in addition to securing the respective ends of the coil 22 as later described in FIG. 1A. A self-tapping screw 22*c* secures the top coil clamp 22*a* to the top portion of the eighty-meter resonator capacitor section 18. A forty-meter resonator capacitor metal section 26 having a lower hollow tubular lower portion of a diameter that telescopes over the eighty-meter resonator capacitor section above the insulator assembly 24 and secures thereto with a self-tapping screw 28. A forty-meter resonator coil 30 clamps between a top portion of the forty-meter resonator capacitor section 26 to a position immediately below an insulator assembly 32 as later described. Coil clamps 30*a* and 30*b* surround the top portion of the forty-meter resonator capacitor section and position immediately below the insulation assembly 32 respectively, and secure thereto with nut and bolt assemblies in addition to securing the respective ends of the coil 30. A self-tapping screw 30*c* secures the top coil clamp 30*a* to the top portion of the forty-meter resonator capacitor section 26. A lower end of a first metal section of hollow tubing 34 is of a diameter which telescopes over the top portion of the forty-meter resonator capacitor section 26 above the insulator assembly 32 and secures thereto with a self-tapping screw 36. A lower end of a second metal section of hollow tubing 38 is of a diameter which telescopes into the top portion of the first metal section 34 and secures thereto with a self-tapping screw 40, a lower end of a third metal section of hollow tubing 42 is of a diameter which telescopes into the top portion of the second metal section 38 and secures thereto with a self-tapping screw 44. A lower end of a fourth metal section of hollow tubing 46 is of a diameter which telescopes into the top portion of the third metal section 42 and secures thereto with a self-tapping screw 48. A lower end of a fifth metal section 52 is of a diameter which telescopes with a slotted top portion 50 of the fourth metal section 46 and secures thereto with a hose clamp 54. A lower end of a sixth metal section 58 is of a diameter which telescopes into a slotted top portion 56 of the fifth metal section 52 and secures thereto with a hose clamp 60. A fifteen-meter stub assembly 62 electrically and physically connects to the fifth section 52** as now described in detail.

The fifteen-meter stub assembly 62 includes a metal strip 64 electrically and physically secured to the fifth metal section 52 by a nut and bolt assembly 66, a metallic rod 68 wrapped around a nut and bolt assembly 70 and extending downwardly parallel to the third through fifth sections 42–54, a section of hollow metal tubing 72 having an inner diameter which accepts the rod 68, and standoff insulators 76 and 78 between the tubing 72 and the second and third sections 38 and 42 which physically spaces the stub assembly 62 from the upper portion of the vertical antenna 10. A screw 71 electrically and physically secures the rod 68 to the hollow tube 72.

An impedance matching coil 62 connects between the nut and bolt assembly 20 in the bottom of the eighty-meter resonator capacitor section 18, and the nut and bolt assembly 16 in the top of the hollow tubular mounting post 12. A matching section length of seventy-five ohm coaxial cable transmission line 64 connects in parallel across the impedance matching coil, and terminates in a suitable coaxial plug such as a PL-259. An electrical ground connects to the nut and bolt assembly 16, and the metal hollow tubular mounting post 12. The metal portions of the vertical antenna 10 can be aluminum tubing of predetermined diameter by way of example and for purposes of illustration while the insulators can be fiberglass, polyethylene, etc., by way of example and for purposes of illustration as later described.

Figure 1A:
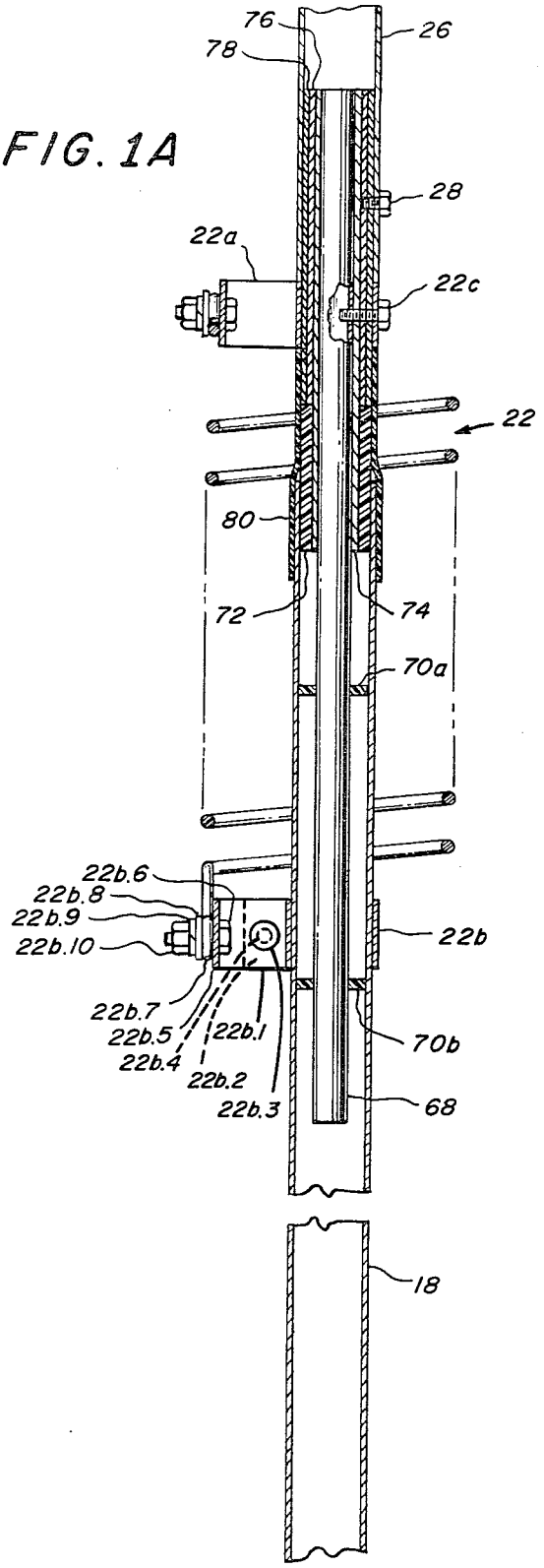
FIG. 1A illustrates a section of the present invention taken on the line 1A—1A of FIG. 1 looking in the direction of the arrows.

FIG. 1A, which illustrates a section of the vertical antenna taken on the line 1A—1A of FIG. 1 looking in the directions of the arrows, shows an internal metal tube 68 spaced by spacers 70*a* and 70*b* as illustrated in the figure from the eighty-meter resonator capacitor metal section 18. An insulation sleeve 72, such as fiberglass by way of example and for purposes of illustration only, is accommodated between the eighty-meter resonator capacitor section 18 and the internal tube 68. A first metal shim tube 74 of a predetermined diameter telescopes over the internal tube 68 and into the fiberglass sleeve 72. A second metal shim tube 76 of a predetermined diameter telescopes over the first metal shim tube 74 and abuts up against the top of the fiberglass sleeve 72. A third metal shim tube 78 of a predetermined diameter telescopes over the second metal shim tube 76 and abuts up against the top of the fiberglass sleeve 72. An insulation sleeve 80 such as polyethylene, by way of example and for purposes of illustration only, extends and surrounds the fiberglass sleeve 72, and extends to a point just above the fiberglass sleeve 72 and to a point just below the top of the eighty-meter resonator capacitor metal section 18. The top coil clamp 22*a* clamps around the third metal shim tube 78 and is electrically affixed thereto with the self-tapping sheet metal screw 22*c* which passes through the metal tubes 78, 76, 74 and 68 in order. The bottom metal coil clamp 22*b* being identical to the top coil clamp 22*a* clamps around the eighty-meter resonator capacitor metal section 18 as later described in detail. The coil 22 of sixteen turns of aluminum tie wire by way of example and for purposes of illustration only on a four-inch diameter connects between the top coil clamp and the bottom coil clamp 22*a* and 22*b* respectively. The coil clamp 22*b* includes overlapping flanges 22*b*..1 and 22*b*.2 illustrated in imaginary lines having bolt holes 22*b*..3 and 22*b*..4 illustrated as overlapping to accept a nut and bolt assembly for clamping action. Additionally, an extending flange 22*b*..5 extends perpendicular to the overlapping flange 22*b*.1, and is provided with a hole to accept bolt 22*b*.6, the end of the coil wire 22*b*.7, a flat washer 22*b*.8, a lock washer 22*b*.9, and a nut 22*b*.10.

Figure 1B:
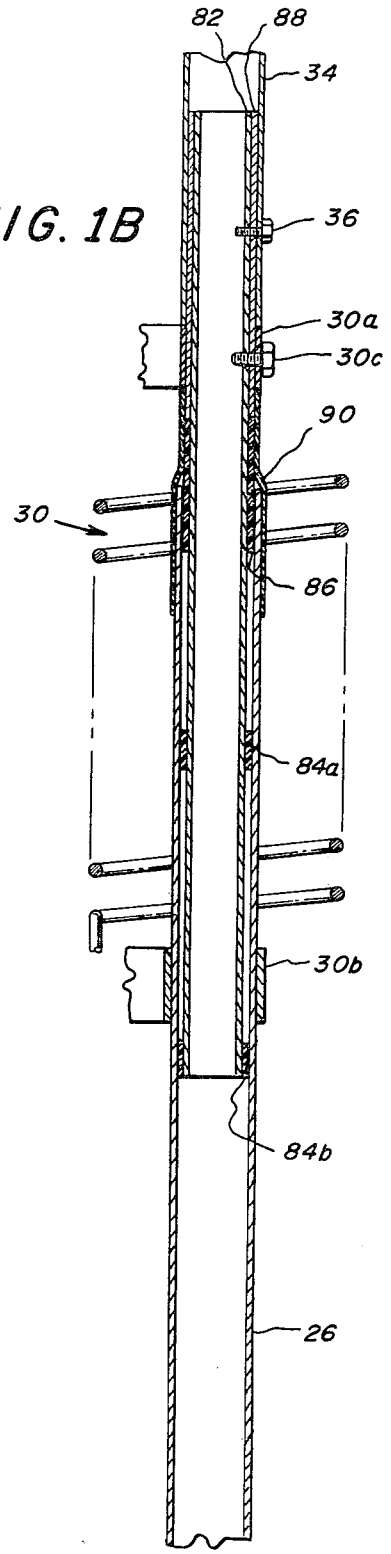
FIG. 1B illustrates a section of the present invention taken on the line 1B—1B of FIG. 1 looking in the direction of the arrows; and, FIG. 2 illustrates a plan view of a second embodiment of a vertical antenna.

FIG. 1B, which illustrates a section of the vertical antenna taken on the line 1B—1B of FIG. 1 looking in the direction of the arrows, shows an internal metal tube 82 spaced by spacers 84*a* and 84*b* from the forty-meter resonator capacitor metal section 26. An insulation sleeve 86 such as fiberglass by way of example and for purposes of illustration only is accommodated between the internal tube 82 and the forty-meter resonator capacitor metal section 26. A first metal shim tube 88 telescopes over the internal metal tube 82 and abuts up against the top of the fiberglass sleeve 86. An insulation sleeve 90 such as polyethylene, by way of example and for purposes of illustration only, extends and surrounds the fiberglass sleeve 86, and extends to a point just above the fiberglass sleeve 86 and to a point just below the top of the forty-meter resonator capacitor metal section 26. The top coil clamp 30*a* clamps around the first metal shim tube 88 and is electrically secured thereto with the self-tapping screw 30*c* which passes through the metal tubes 82 and 88 in order. The bottom metal coil clamp 30*b* clamps around the forty-meter resonator capacitor metal section 26. The coil 30 of eleven turns of aluminum tie wire by way of example and for purposes of illustration only, on a four-inch diameter connects between the top and bottom coil clamps 30*a* and 30*b* respectively.

Preferred Mode of Operation of First Embodiment

The mounting post 12 of FIG. 1 is set into a suitable hole, approximately in the range of twenty-one inches deep, so that the upper end of the insulator 14 clears the ground by five or six inches. The earth is packed tightly around the mounting post and concrete can be utilized for additional strength.

A number eight one and three-quarter inch bolt 16 passes through the braid lug of the coaxial cable impedance matching transmission line 64, through a flat washer, through the lower loop of the impedance matching coil 62, through another opposing flat washer, through the hole in the mounting post 12 and the insulator 14, and secures with a flat washer, a lock washer, and a number eight nut. The eighty-meter resonator coil 22 has two clamps, one large 22*b* and one small 22*a*. Remove a bolt assembly from the large clamp 22*b* and spread the large clamp 22*b* slightly. The top of eighty-meter resonator capacitor section 18 is first passed through the large clamp 22*b*, the eighty-meter resonator coil 22, and then through the small clamp 22*a*. The larger clamp 22*b* is positioned below the insulation 24. The screw hole in the small clamp 22*a* of eighty-meter resonator coil 22 is aligned with the lower screw hole in the top of section 18, and secured with a number ten twenty-four self-tapping screw 22*c* through the small clamp 22*a* into the eighty-meter resonator capacitor section 18. The one-quarter inch by one-inch bolt is replaced in the large clamp 22*b*, the large clamp 22*b* is slid down the eighty-meter resonator capacitor section 18 to a predetermined position, and subsequently the large clamp 22*b* is tightened. The forty-meter resonator coil 30 is installed on the forty-meter resonator capacitor section 26 in a like manner and tightened at a predetermined position.

The lower end of first metal section 34 telescopes onto the top of forty-meter resonator capacitor section 26. The screw holes are aligned in the sections 34 and 26, and secured with a number ten twenty-four self-tapping screw 36. The bottom of second metal section 38 telescopes into the top of first metal section 34 and the screw holes are aligned and secured with a number ten twenty-four self-tapping screw 44. An insulator 78 is positioned over the second metal section 38 and the third metal section 42. The third metal section 42 telescopes into the second metal section 38, and the screw holes are aligned and secured with a number ten twenty-four self-tapping screw 44. The fourth metal section 46 telescopes into the third metal section 42, and the screw holes are aligned and secured with a number six thirty-two self-tapping screw 48. The fifth metal section 52 telescopes into the fourth metal section 46 and the small stainless steel hose clamp 54 is positioned over the top slotted end 50 of the fourth metal section 46 and tightened thereto. The sixth metal section 58 installs likewise as the fifth metal section 52. The rod 68 telescopes into the metal section 72, the metal section is positioned in the insulators 76 and 78, the rod 68 is secured to the bracket 64 about nut assembly 70 and the bracket 64 is secured to the fifth metal section with nut assembly 66. The bottom of the eighty-meter resonator capacitor section 18 is positioned over the top of the mounting post 12, and the screw holes aligned. A number eight by one and three-quarters inch bolt 20 passes through the center lug of the coaxial cable impedance matching transmission line 64, through a flat washer, through the upper loop of the impedance matching coil 62, through another opposing flat washer, through the sections 18 and 14 and is secured with a flat washer, a lock washer, and a number eight nut. The assembly of sections 26–58 is raised and positioned atop by telescoping the bottom of the forty-meter resonator capacitor section 26 over the top of the eighty-meter resonator capacitor section 18, aligning the screw holes, and securing with a number ten-twenty-four self-tapping screw 28.

The vertical antenna 10 produces very low standing wave ratio (SWR) readings over the twenty-, fifteen-, and ten-meter bands, and the eighty/seventy-five and forty-meter resonator circuits are predetermined and set for resonances of approximately 3700 and 7100 Khz. Inasmuch as some variation can be expected, the following procedure is utilized to adjust the vertical antenna 10 for minimum SWR at any desired point in each of the five bands of the HF spectrum. SWR readings can be taken at the transmitter end of the coaxial cable transmission feedline, or at the junction of the coaxial cable transmission feedline which is fifty-two ohm and the seventy-five ohm impedance matching transmission line 64 for greater accuracy.

The frequency of minimum SWR on fifteen meters is predetermined. To raise the frequency, the sliding sections 68 and 72 are telescoped closer together or to lower frequency, the sections 68 and 72 are slid further apart. The length of the stub assembly 62 is one-quarter wavelength or, nominally, twelve feet in length. The frequency of minimum SWR on twenty meters is predetermined. To raise or lower the frequency, the total length of sections 38 through 58 is adjusted by varying the amount of overlap between sections 52 and 58 a few inches. The frequency of minimum SWR on ten meters is predetermined. The twenty-meter adjustment also determines the ten-meter resonant frequency, but resonance on both bands is so broad that slight adjustments for the sake of improved SWR on one band does not significantly affect SWR on the other. The frequency of minimum SWR on forty meters is predetermined. Adjustment is made by loosening the lower clamp 30*b* of the forty-meter resonator coil 30, and compressing or expanding the spacing between coil turns to lower or raise the frequency respectively. One-half inch of travel will move the frequency of minimum SWR by approximately seventy Khz. When the proper setting has been determined, the lower clamp 30*b* is tightened in place. The frequency of minimum SWR on eighty or seventy-five meters is predetermined. Adjustment is made in a like manner by repositioning the lower clamp 22*b* on the eighty/seventy-five meter resonator coil 22. When the proper setting has been determined and the lower clamp 22*b* is tightened, the impedance matching coil 62 is adjusted at the base of the vertical antenna 10 by spreading the turns farther apart or squeezing them closer together until the SWR drops to a minimum value. One adjustment of the impedance matching coil should suffice for operation over the entire 3500–4000 Khz range, provided that the necessary adjustments are made to the eighty/seventy-five meter resonator coil 22. In general, the forty and eighty/seventy-five meter adjustments will not significantly affect adjustments previously made for twenty, fifteen, and ten meters. However, if the eighty/seventy-five meter tuning is readjusted for operation at a much higher or lower frequency, it may be necessary to readjust the forty-meter turning in order to maintain SWR of less than 2:1 at both band edges.

The vertical antenna 10 is constructed of commercially available components including aluminum tubing of $\frac{3}{8}$ $\frac{1}{2}$ $\frac{5}{8}$ $\frac{3}{4}$ $\frac{7}{8}$ 1, and $1\frac{1}{8}$ inch outer diameters of predetermined lengths, aluminum tie wire, polyethylene tubing, ABS cement, fiberglass sleeves and insulators, and the like components. The aluminum tubing can be 0.058 wall 6061—T6 leading to an antenna weight in the range of ten and one-half pounds. The height of the antenna is 26 feet. The eighty-meter resonator capacitor section 18 is five and one-half feet; the forty-meter resonator capacitor section is twenty inches; the first section 34 is one inch by four feet; the second section 38 is $\frac{7}{8}$ inches by four feet; the third section 42 is $\frac{3}{4}$ inches by four feet; the fourth section 46 is $\frac{5}{8}$ inch by four feet; the fifth section 52 is $\frac{1}{2}$ inch by two feet; and the sixth section 58 is $\frac{3}{8}$ inch by thirty inches. The fifteen-meter stub assembly 62 is three-sixteenths inch rod and hollow tubing, or in the alternative, can be made entirely of three-sixteenths rod joined together by a clamp.

The vertical antenna is capable of handling transmitter input power of 2000 watts SSB or 1000 watts CW on forty-ten meters, 1500 watts PEP or 500 watts CW on eighty/seventy-five meters. Fifty-ohm coaxial cable transmission line connects to the impedance matching section 64. The VSWR at resonance is 1.5:1 or less with a VSWR 2:1 or less for forty through ten meters and 60–100 Khz on eighty meters.

Description of Second Preferred Embodiment

Figure 2:
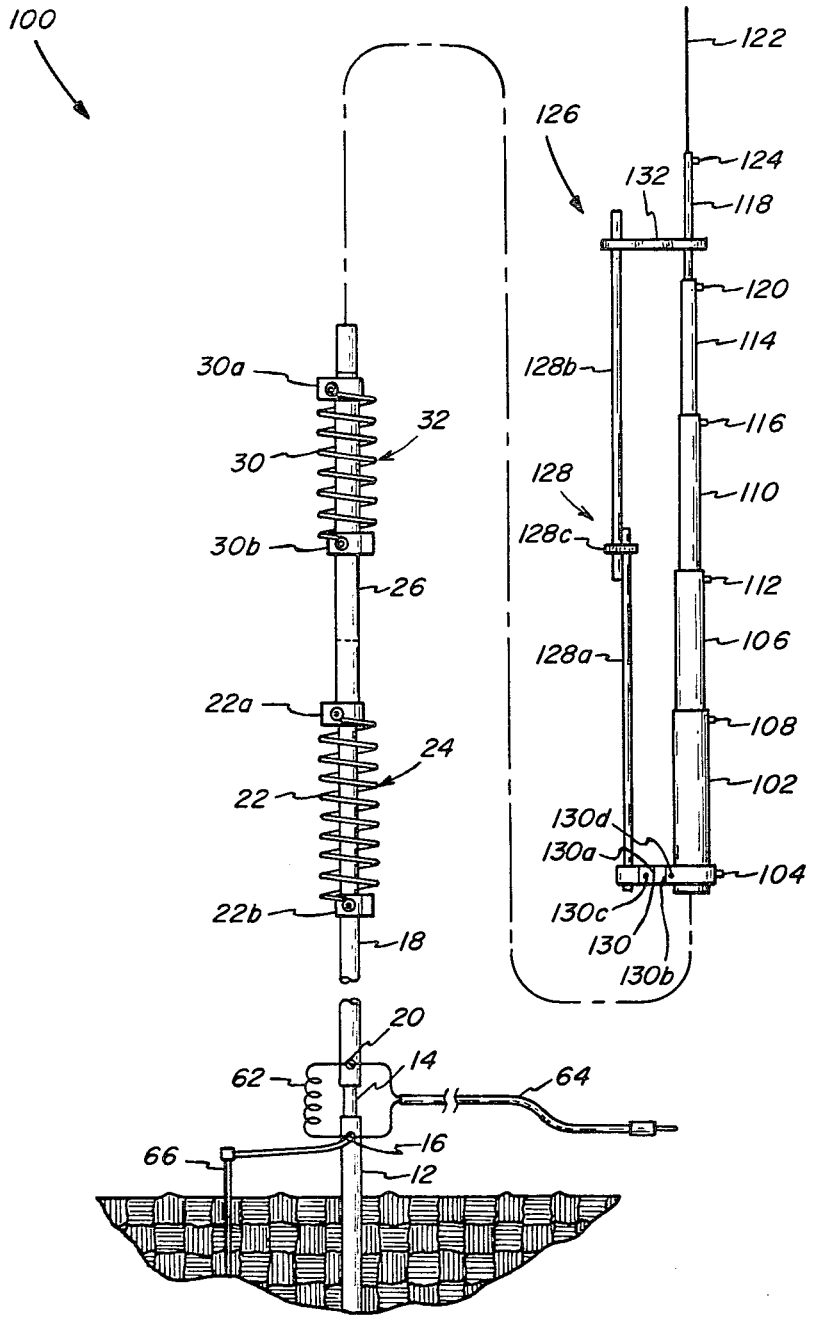

FIG. 2, which illustrates a vertical plan view of a vertical antenna 100, a second preferred embodiment of the present invention, shows existing elements 10–32 and 62–66 as previously delineated which function in an identical manner as previously set forth in the description of the first preferred embodiment 10 of the present invention, and for purposes of brevity will not be reiterated and by reference are incorporated herein.

First through sixth elements metal sections 102, 106, 110, 114, 118, and 122 telescope into each other as previously described for elements 34, 38, 42, 46, 52, and 58 and secure to each other with self-tapping screws 104, 108, 112, 116, and hose clamps 120 and 124 respectively. As illustrated in the figure, a fifteen-meter stub assembly electrically and physically connects at the lower end of the first metal section 102 as now described in detail.

The fifteen-meter stub assembly 126 includes longitudinal vertical metal rod members 128*a* and 128*b* slidably joined together by a hose clamp 128*c* forming an electrical and physical connection. The rods 128*a* and 128*b* are electrically and physically secured to the lower end of the first metal section 102 with a metal wrap-around bracket 130 including one end 130*a* wrapped around the metal rod 128 and secured thereto with a self-tapping sheet metal screw and the other end 130*b* wrapped around the metal tube 102 and secured thereto with a self-tapping sheet metal screw 130*d* and the screw 104. A stand-off insulator 130 of plastic or like material has respective holes which accept the upper end of the rod 128 and the fifth metal element 118 and is slid over each respective member. The overall height of the stub assembly 126 is substantially one-quarter wavelength but, dependent upon electrical characteristics, is usually slightly less than one-quarter wavelength.

Preferred Mode of Operation of Second Embodiment

The vertical antenna 100 of the second embodiment is installed in a similar manner to the vertical antenna 10 of the first embodiment, and for sake of brevity the discussion is not repeated, and by reference is incorporated herein. The primary difference is that the adjustment for operation on fifteen meters is determined by the overall height of the stub 126, and particularly by the length of the rods 128*a* and 128*b*. For fifteen-meter operation the height of the stub is approximately ten and one-half feet, slightly less than one-quarter wavelength, providing for a selective operating portion of nominal band width on fifteen meters.

The entire vertical antenna 100 is active on all five bands. On fifteen meters, the entire vertical portion from element 20 to element 122 and the stub 128 radiates rf energy. The stub 128 along the overall structure of the vertical antenna 100 provides for a high feedpoint impedance.

Various modifications can be made to the vertical antenna of the present invention without departing from the apparent scope thereof. The resonance on segments of the high-frequency spectrum is predetermined for the desired frequency of operation and is not limited to the eighty/seventy-five, forty, twenty, fifteen and ten segments of the present invention which has been by way of example and for purposes of illustration only, and is not to be construed as limiting of the present invention.

Having thus described the invention, what is claimed is:

1. Vertical antenna resonating on five predetermined segments of the high-frequency spectrum comprising:

a. first resonator capacitor means vertically supported and comprising an eighty-seventy five meter resonator capacitor section and including an eighty-seventy meter resonator inductor connected in parallel across the top of said capacitor section whereby said resonator adjusts the center frequency of operation;

b. second resonator capacitor means vertically connected to said first resonator capacitor means and comprising a forty-meter resonator capacitor section and including a forty-meter resonator inductor connected in parallel across the top of said capacitor section whereby said resonator adjusts the center frequency of operation;

c. vertical radiating means including a stub means and connected to said second resonator capacitor means, said vertical radiating means comprising first, second, third, fourth, fifth, and sixth vertical radiating sectional elements internally secured to each of the other respective elements whereby the telescoping of said sections adjusts the center frequency of operation on twenty and ten meters and said stub means comprising a quarter wavelength long stub connected in parallel to said vertical radiating means towards an upper point whereby said stub telescopes to adjust the center frequency of operation; and d. an impedance matching coil connected across said first resonator capacitor means and ground, a coaxial cable transmission line impedance matching section connected across said impedance matching coil, and said vertical antenna having a height in the range of twenty-five to twenty-six feet whereby a coaxial cable transmission line connects to said first resonator capacitor means and ground, and the entire vertical radiating length of said vertical antenna is active on four of said five high-frequency spectrum segments and said stub means decouples said vertical radiating means above said stub means thereby yielding a quarter wave vertical radiating means on the frequency corresponding to the length of said stub means.

2. The vertical antenna of claim 1 wherein said vertical radiating means comprises a longitudinal metal tube.

3. A vertical antenna for operation on the eighty/seventy-five, forty, twenty, fifteen and ten meter amateur bands of the high-frequency spectrum comprising:

a. tubular support post including a solid fiberglass insulator extending therefrom and secured to said support post with a nut and bolt assembly;

b. eighty-meter resonator capacitor section including an eighty-meter resonator inductor supported at the top of said eighty-meter resonator capacitor section and connected in parallel across said capacitor section and vertically supported on said insulator;

c. forty-meter resonator capacitor section including an eighty-meter resonator inductor supported at the top of said forty-meter resonator capacitor section and connected in parallel across said forty-meter resonator capacitor section and vertically affixed to said eighty-meter resonator capacitor section;

d. first, second, third, fourth, fifth and sixth vertical radiating elements, said first element vertically affixed to the top of said forty-meter resonator capacitor section with a self-tapping sheet metal screw, said second element telescoped into said first element and secured thereto with a self-tapping sheet metal screw, said third element telescoped into said second element and secured thereto with a self-tapping sheet metal screw, said fourth element telescoped into said third element and secured thereto with a self-tapping sheet metal screw, said fifth element telescoped into a slotted top portion of said fourth element and secured thereto with a hose clamp, and said sixth element telescoped into a slotted top portion of said fifth element and secured thereto with a hose clamp; and, e. fifteen-meter quarter wave stub section including insulators positioned over and extending outwardly from said second and third elements, a hollow tube supported parallel to and away from said vertical radiating elements, a rod telescoped into said tube and electrically affixed thereto with a self-tapping sheet metal screw, and a bracket including nut and bolt assemblies affixing a top of said rod to said fifth element, said rod and tube one quarter wavelength of fifteen meters in length, whereby said eighty-meter resonator adjusts the center frequency of operation on eighty meters, said forty-meter resonator adjusts the center frequency of operation on forty meters, the center frequency of operation on twenty meters is adjusted by telescoping said radiating elements into each other, the center frequency of operation on fifteen meters adjusted by telescoping said rod into said tubing of said stub, and the center frequency of operation on ten meters is adjusted by telescoping said radiating elements into each other for low voltage standing wave ratio on each of the center frequencies.

4. A vertical antenna for operation on the eight/seventy-five, forty, twenty, fifteen and ten meter amateur bands of the high-frequency spectrum comprising:

a. tubular support post including a solid fiberglass insulator extending therefrom and secured to said support post with a nut and bolt assembly;

b. eighty-meter resonator capacitor section including an eighty-meter resonator inductor supported at the top of said eighty-meter resonator capacitor section and connected in parallel across said capacitor section and vertically supported on said insulator;

c. forty-meter resonator capacitor section including a forty-meter resonator inductor supported at the top of said eighty-meter resonator capacitor section and connected in parallel across said forty-meter resonator capacitor section and vertically affixed to said eighty-meter resonator capacitor section;

d. first, second, third, fourth, fifth and sixth vertical radiating elements, said first element vertically affixed to the top of said forty-meter resonator capacitor section with a self-tapping sheet metal screw, said second element telescoped into said first element and secured thereto with a self-tapping sheet metal screw, said third element telescoped into said second element and secured thereto with a self-tapping sheet metal screw, said fourth element telescoped into said third element and secured thereto with a self-tapping sheet metal screw, said fifth element telescoped into a slotted top portion of said fourth element and secured thereto with a hose clamp, and said sixth element telescoped with a slotted top portion of said fifth element and secured thereto with a hose clamp; and, e. fifteen-meter stub section including insulators positioned over and extending outwardly from said fifth element, a rod supported parallel to and away from said vertical radiating elements, a rod telescoped into said tube and electrically affixed thereto with a self-tapping sheet metal screw, and a bracket including nut and bolt assemblies affixing a bottom of said rod to a bottom said first element, said rods substantially one-quarter wavelength in length, whereby said vertical antenna is active on all frequencies.

5. The vertical antenna of claim 3 wherein said first through sixth vertical radiating elements comprise a longitudinal metal tube.

6. The vertical antenna of claim 3 comprising an impedance matching coil connected across a lower portion of said eighty-meter resonator capacitor section and ground.

7. The vertical antenna of claim 6 comprising a coaxial cable transmission impedance matching section connected across said impedance matching coil.

8. The vertical antenna of claim 3 having a height in the range of twenty-five to twenty-six feet.

9. The vertical antenna of claim 4 wherein said first through sixth vertical radiating elements comprise a longitudinal metal tube.

10. The vertical antenna of claim 4 comprising an impedance matching coil connected across a lower portion of said eighty-meter resonator capacitor section and ground.

11. The vertical antenna of claim 10 comprising a coaxial cable transmission impedance matching section connected across said impedance matching coil.

12. The vertical antenna of claim 4 having a height in the range of twenty-five to twenty-six feet.

* * * * *